US005203408A

United States Patent [19]

Boscher

[11] Patent Number: 5,203,408

[45] Date of Patent: Apr. 20, 1993

[54] TOOL SAVER

[75] Inventor: Robert Boscher, Drayton Valley, Canada

[73] Assignee: Frontier Oilfield Sales Ltd., Alberta, Canada

[21] Appl. No.: 801,442

[22] Filed: Dec. 2, 1991

[51] Int. Cl.[5] ..... E21B 23/00

[52] U.S. Cl. ..... 166/70; 166/75.1

[58] Field of Search ..... 166/70, 75.1, 85, 8 D

[56] References Cited

U.S. PATENT DOCUMENTS

| | | | |
|---|---|---|---|
| 1,422,289 | 7/1922 | Moody . | |
| 1,669,655 | 5/1928 | Cermier | 166/70 |
| 1,802,565 | 4/1931 | Lacey | 166/75.1 X |
| 2,058,825 | 10/1936 | Rallet et al. | 166/70 |
| 2,144,403 | 1/1939 | Davidson | 166/70 |
| 2,350,863 | 6/1944 | Bailey | 166/70 |
| 2,375,432 | 5/1945 | Miller et al. | 166/75.1 X |
| 2,615,519 | 10/1952 | Carr | 166/70 |
| 2,710,064 | 6/1955 | Osmun | 166/70 |
| 3,216,500 | 11/1965 | Diehl | 166/85 |
| 4,076,337 | 2/1978 | Childress | 308/3.9 |
| 4,096,608 | 6/1978 | Lagerstedt | 24/249 R |
| 4,299,280 | 11/1981 | Greer | 166/75.1 |
| 4,681,168 | 7/1987 | Kisling, III | 166/70 X |
| 4,898,238 | 2/1990 | Grantom | 166/75.1 |

FOREIGN PATENT DOCUMENTS

| | | | |
|---|---|---|---|
| 1400219 | 4/1965 | France | 166/75.1 |

*Primary Examiner*—Hoang C. Dang

*Attorney, Agent, or Firm*—Fishman, Dionne & Cantor

[57] ABSTRACT

A housing, having at least a top wall and a spaced parallel bottom wall, has aligned openings in the top and bottom walls and a path extending between the aligned openings. The housing is mounted over a well bore so that the openings are aligned with the well bore. In the housing are a pair of blocks which are pivotable from an open position, in which the path is cleared, to a closed position, in which the blocks extend across the path. Wire line tools are mounted through the housing into the bore and thence into the well. When the tools are raised from the well, the blocks are in their closed position whereby to prevent the tools from falling back into the well should the wire break.

5 Claims, 3 Drawing Sheets

41
63
59
55
37
15
19
11
11
41
7
9
21
I
33
29
49
25
25
III
45
47
III
23
39
31
23
51
27
21
13
53
35
19
17
57
61
39

TOOL SAVER

BACKGROUND OF THE INVENTION

1. Field of the Invention

The invention relates to a tool saver for use in association with oil or gas wells or the like. More specifically, the invention relates to a tool saver which prevents tools, when withdrawn from a borehole of a well, from falling back into the well in the event of a break in the wire line which lowers and raises the tools.

2. Description of Prior Art

As is known in the art, wire line tools for wells, such as, for example, sand line swabbing equipment, sinker bars, etc., are lowered into and raised out of wells through the well bores of the wells by wire lines. There is a constant danger that, after the tool is raised out of the well, the wire line will break and the tool will fall uncontrollably back into the well. The tool will then have to be retrieved at great cost and inconvenience.

Various devices are known for gripping tools or pipes as they are lowered into wells. Examples of such devices are taught in, for example, U.S. Pat. Nos. 1,422,289, Moody, Jul. 11, 1922, 4,076,337, Childress, Feb. 28, 1978, 4,096,608, Lagerstedt, Jun. 27, 1978 and 4,898,238, Grantom, Feb. 6, 1990.

The '289 patent teaches a device for gripping casings or sections of pipes as they are being raised or lowered into a well. Specifically, the device will hold one section while another section is being coupled or uncoupled.

The drill steel holder of the Childress patent, U.S. Pat. No. 4,076,337, comprises levers 26 and 28 (see FIGS. 3 and 4) having outboard ends connected to a RAM 40. The RAM 40 can draw the outboard ends towards each other or force them apart from each other.

The inboard ends of the levers 26 and 28 comprise rollers 50. When the inboard ends of the levers are drawn towards each other, as shown in FIG. 3, the rollers will embrace a tool, for example a steel drill 68, to prevent the vertical movement of the steel drill.

Jaws 24 and 25 of U.S. Pat. No. 4,096,608, (having inserts 28 and 29) are forced towards each other by a spring 49 to capture a drill pipe 19 as shown in FIG. 2 of the drawings. As seen in FIG. 1, this will prevent the drill pipe 19 from moving in a vertical direction.

In U.S. Pat. No. 4,898,238, Grantom, a stationary jaw 200 acts together with a gripping, or movable, jaw 300 to capture a pipe or the like which is inserted into a well. As seen in FIG. 1, the movable jaw 300 is moved by the action of threaded shaft 320 in threaded block 310.

As is quite clear, none of the references address themselves to the problem as above described.

SUMMARY OF INVENTION

It is therefore an object of the invention to provide a tool saver for use in association with oil or gas wells or the like.

It is a more specific object of the invention to provide a tool saver for saving tools which are lowered into and raised out of a well through a borehole by wire lines.

It is a still more specific object of the invention to provide a tool saver which will prevent tools, which have been raised out of a well by a wire line, from falling back into the well.

In accordance with an embodiment of the invention, there is provided a tool saver for mounting over a well bore, comprising:

a housing having at least a top wall and a spaced parallel bottom wall;

aligned openings in said top and bottom walls;

wherein, said housing is mounted over said well bore so that said openings are aligned with said well bore;

and including, within said housing, arresting means operable to permit the passage of tools through said aligned openings in said housing when said tools are being lowered into and raised out of said well, and for preventing said tools from falling back into said well when said tools have been withdrawn from said well.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
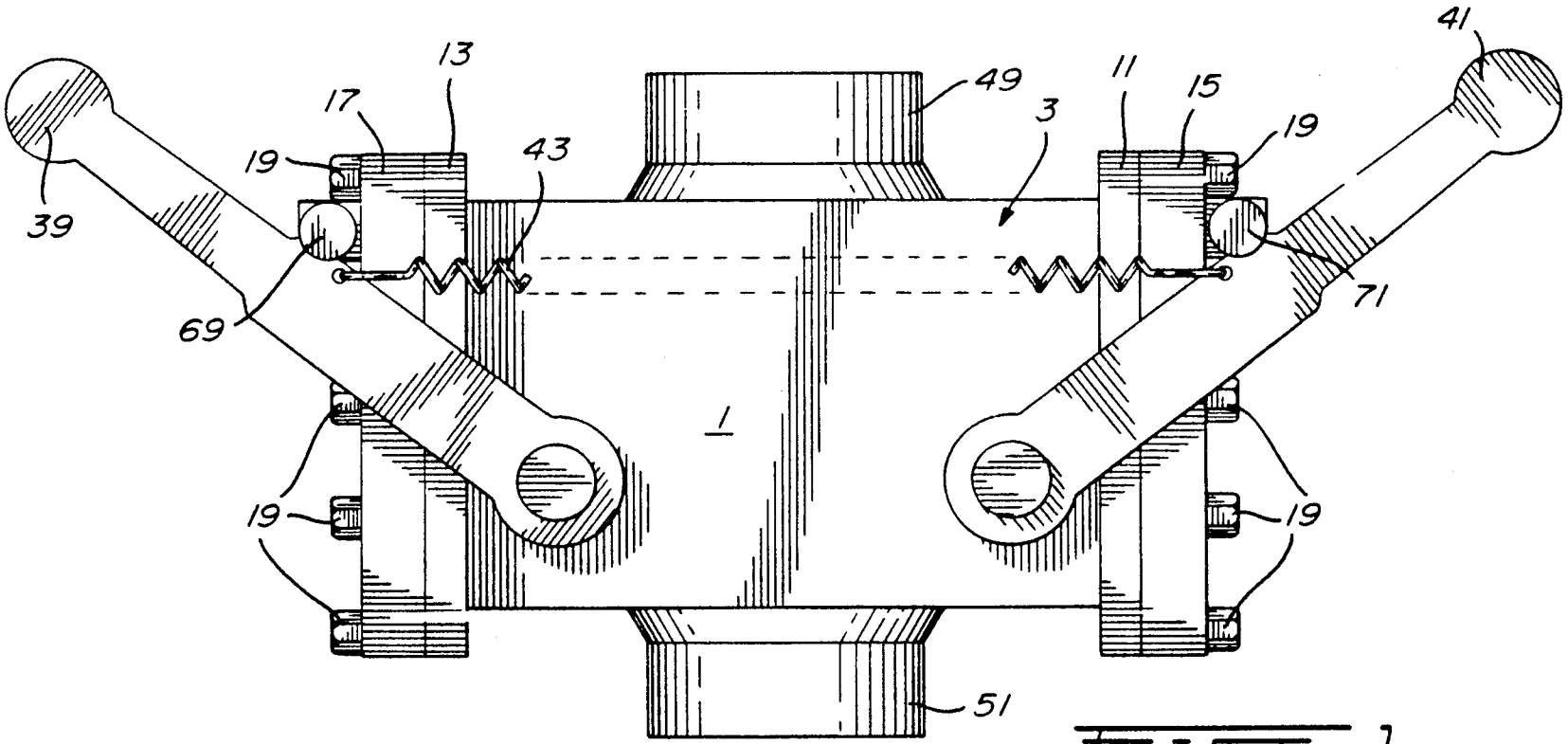
FIG. 1 is a front view of a specific embodiment of a tool saver.

Referring to the drawings, the illustrated embodiment comprises a housing 1 including a tubular member 3 having spaced parallel side walls 5 and 6 (see FIG. 3) which separate top wall 7 from spaced parallel bottom wall 9. End flanges 11 and 13 surround the two ends of the tubular member 3. End wall 15 is connected to end flange 11 and end wall 17 is connected to end flange 13. The end walls are connected to their respective end flanges by a plurality of bolts 19 which extend into bolt holes 21 see FIG. 3) in the end flanges.

Disposed within the housing are arresting means comprising, for example, movable blocks 23 and 25. The blocks 23 and 25 are attached to respective shafts 27 and 29 by respective keyways 31 and 33 and respective screws 35 and 37. The keyways ensure the correct orientation of the blocks with respect to the shafts, and the screws prevent the blocks from falling off the shafts.

Attached to respective shafts 27 and 29 by, for example, welding are handles 39 and 41. As can be seen, the keyways 31 and 33 are aligned with the directions of the respective handles 39 and 41. Thus, the blocks 23 and 25 are maintained at a right angle to their respective handles 39 and 41.

As seen in FIG. 1, spring 43 is connected, at respective ends thereof, to handles 39 and 41. The spring 43 forces the handles towards each other to the position as shown in FIG. 2.

Figure 2:
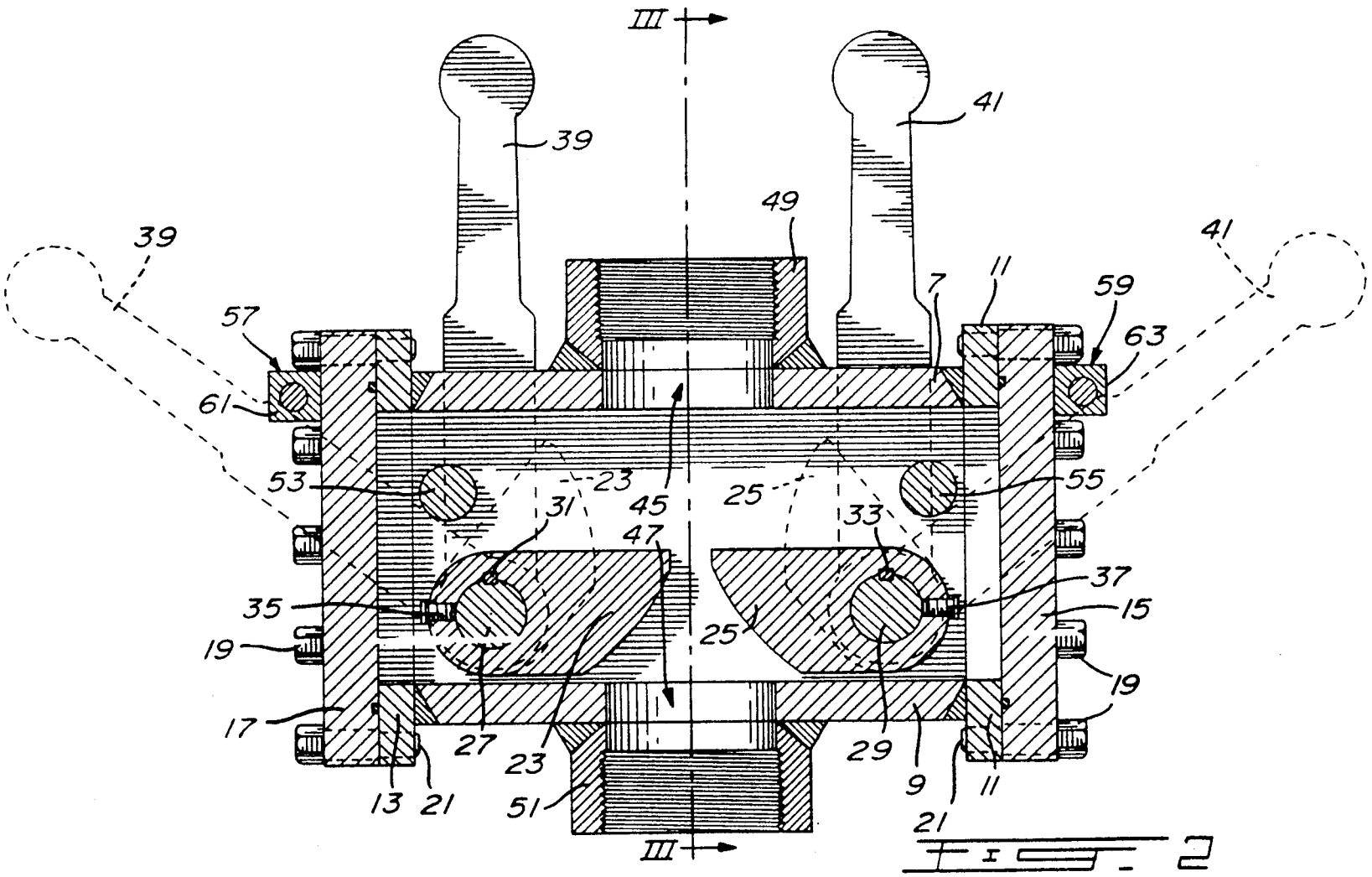
FIG. 2 is a section through II—II of FIG. 4.

As seen in FIG. 2, aligned openings 45 and 47 extend through top wall 7 and bottom wall 9 respectively, and collars 49 and 51 surround the openings 45 and 47 respectively.

Also disposed within the housing are stop pins 53 and 55. The pins 53 and 55 limit the pivotal motion of blocks 23 and 25 respectively.

Figure 3:
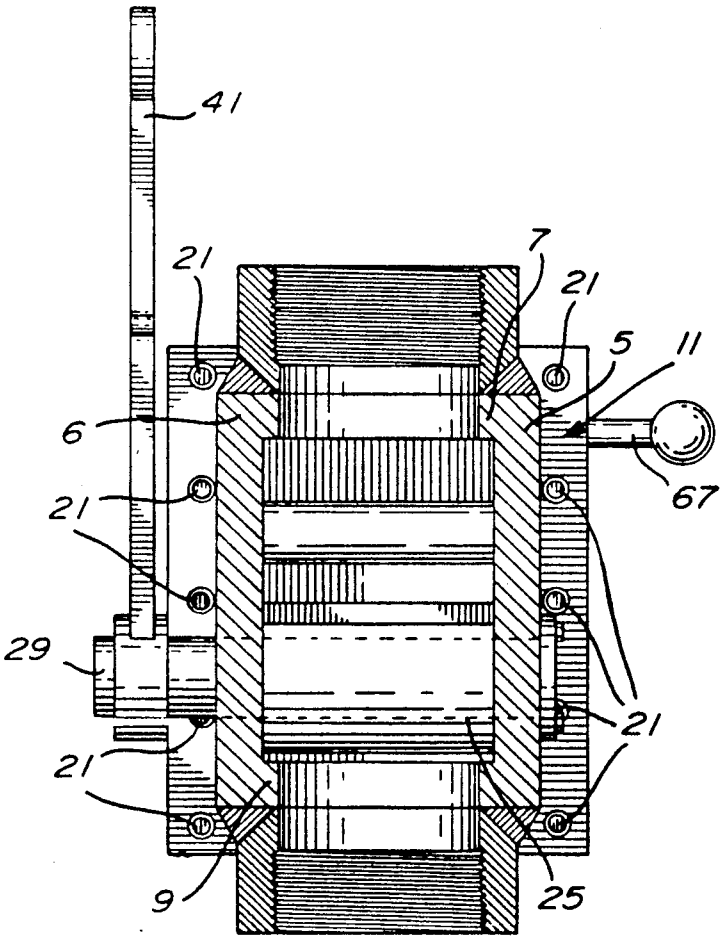
FIG. 3 is a section through III—III of FIG. 2.
Figure 4:
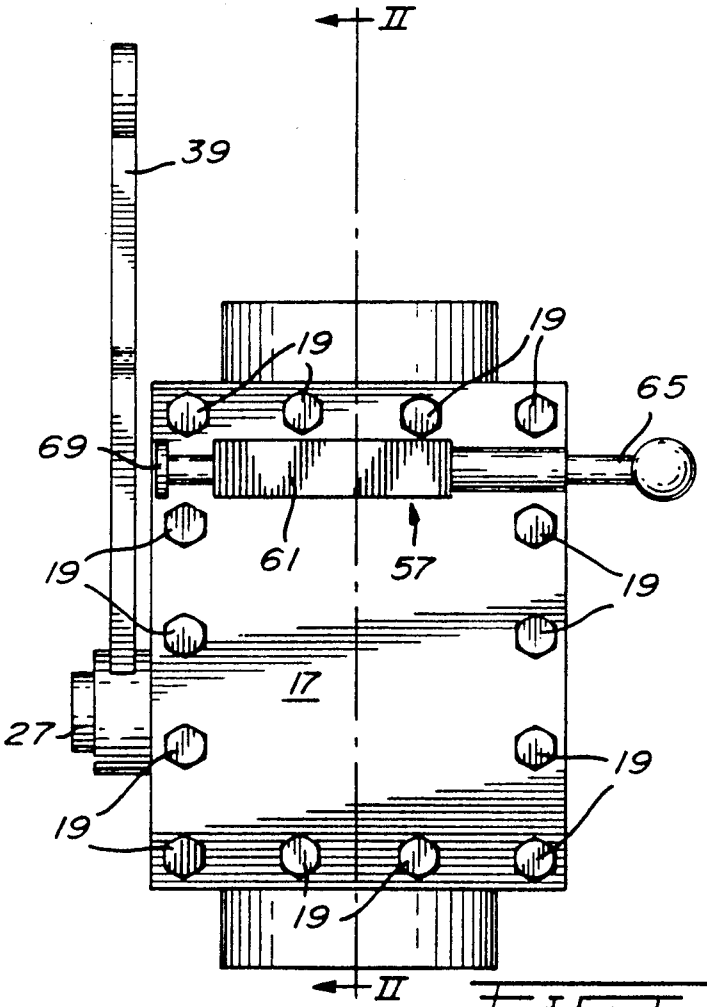
FIG. 4 is an end view of the specific embodiment of the tool saver.

Disposed at respective ends of the housing are holder arrangements 57 and 59. As best seen in FIG. 4, each holder arrangement comprises a housing 61 (63), movable pins 65 and 67 and catch flanges 69 and 71 (which are best seen in FIG. 1). The housings 61 and 63 include spring means (not shown) to bias the pins 65 and 67 into the positions as seen in FIGS. 3 and 4. The pins can be pushed outwardly, against the biasing action of the springs, (leftwardly in FIGS. 3 and 4) to pass the handles 39 and 41 respectively.

In operation, the tool saver is mounted over a well bore and the handles 39 and 41 are separated from each other as illustrated in FIG. 1. Pins 65 and 67 are then pushed forwardly until the flanges 69 and 71 are in front of respective handles 39 and 41. The handles will then be maintained in the position illustrated in FIG. 1 (the open position 0 also shown in dotted lines in FIG. 2) against the biasing force of the spring 43. As seen in FIG. 2, with handles 39 and 41 in the open position, a path is opened between the openings 45 and 47 so that wire line tools can be lowered through the aligned openings into the aligned well bore and thence into the well by the wire line.

When tools are to be raised out of the well, the handles are returned to the position as shown in solid lines in FIG. 2 (the closed position). As the tool is drawn through the housing, it will push the blocks 23 and 25 upwardly and outwardly to open a path so that the tools can pass through the housing. However, after the tool has been withdrawn above the level of the blocks 23 and 25, handles 39 and 41 will be forced together by the action of spring 43 and will assume the position illustrated in solid lines in FIG. 2. The blocks 23 and 25 will now block the path between the openings 45 and 47 so that, if the wire line should break at this point, the tools will be prevented from falling back into the well.

It can therefore be seen that the tool saver will prevent tools from falling back into the well after they have been withdrawn from the well. As the greatest danger that the wire line will break occurs at the time when the tool has been withdrawn from the well, the advantage of the tool saver becomes readily apparent.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A tool saver for mounting over a well bore, comprising:

a housing having at least a top wall and a spaced parallel bottom wall;

aligned openings in said top and bottom walls defining a path through said housing;

said housing being mountable over said well bore so that said openings are aligned with said well bore such that tools may be lowered into and withdrawn out of said well through said aligned openings by a wire line;

a pair of pivoting blocks mounted in said housing, said blocks being pivotable from a closed position, wherein said blocks extend across said path to partially block said path, to an open position wherein the blocks are removed from said path to open said path;

each said block being mounted on a separate shaft for pivoting therewith;

a respective handle being fixedly connected to each said shaft, each handle having one end connected to its respective shaft and a free end;

whereby pivoting said handles will cause said blocks to pivot;

and further including spring means, said spring means having a first end and a second end, said first end of said spring means being connected to the free end of one of said handles and said second end being connected to the free end of the other one of said handles whereby said spring means biases said handles towards each other into said closed position;

adjacent ends of said blocks being spaced from each other to permit the passage of said wire line therethrough even when said blocks are in said closed position;

wherein, when a tool is withdrawn from said well with said blocks being in said closed position, the force of the upward motion of said tool will force apart said blocks, against the bias of said spring, so that said tool can be moved upwardly along said path; and after the tool has passed the blocks in the upper movement thereof, said blocks will automatically be returned to said closed position by the biasing action of said spring means;

whereby, when a tool has been pulled above said pivoting blocks, the pivoting blocks in the closed position will prevent the tool from falling back into said well.

2. A tool saver as defined in claim 1 wherein, when said blocks are in said closed position, said handles are parallel with said path and with each other, and when said blocks are in said open position, said handles are at an angle to said path and to each other.

3. A tool saver as defined in claim 2 and including stop pins mounted in said housing to limit the pivoting movement of said blocks, a separate stop pin being associated with a respective one of said blocks.

4. A tool saver as defined in claim 3 and including spaced, parallel side walls for spacing said top and bottom walls, and end walls at respective ends of said housing;

holding means mounted on said end walls for holding said handles in said open position.

5. A tool saver as defined in claim 4 wherein said housing includes end walls;

holder pins mounted on said end walls and being operative to maintain said handles in said open position when lowering tools through said housing into said well bore.

* * * * *